US006048683A

United States Patent [19]

Mehta et al.

[11] Patent Number: 6,048,683

[45] Date of Patent: Apr. 11, 2000

[54] ROBUST PROCESS FOR THE PREPARATION OF HIGH CHLORIDE EMULSIONS

[75] Inventors: Rajesh V. Mehta; Ramesh Jagannathan; Y. Chea Chang, all of Rochester, N.Y.

[73] Assignee: Eastman Kodak Company, Rochester, N.Y.

[21] Appl. No.: 09/218,683

[22] Filed: Dec. 22, 1998

[51] Int. Cl.[7] ..... G03C 1/015; G03C 1/035; G03C 1/07

[52] U.S. Cl. ..... 430/569; 430/603; 430/611

[58] Field of Search ..... 430/569, 603, 430/611

[56] References Cited

U.S. PATENT DOCUMENTS

| | | | |
|---|---|---|---|
| 4,539,290 | 9/1985 | Mumaw | 430/569 |
| 4,865,962 | 9/1989 | Hasebe et al. | 430/567 |
| 5,252,454 | 10/1993 | Suzumoto et al. | 430/576 |
| 5,252,456 | 10/1993 | Oshima et al. | 430/605 |
| 5,549,879 | 8/1996 | Chow | 430/567 |
| 5,728,516 | 3/1998 | Edwards et al. | 430/567 |
| 5,736,310 | 4/1998 | Chen et al. | 430/567 |
| 5,750,327 | 5/1998 | Chang et al. | 430/569 |
| 5,783,373 | 7/1998 | Mydlarz et al. | 430/363 |
| 5,783,378 | 7/1998 | Mydlarz et al. | 430/567 |
| 5,792,601 | 8/1998 | Edwards et al. | 430/567 |

OTHER PUBLICATIONS

Research Disclosure, vol. 389 Sep. 1996, Item 38957, I.
Research Disclosure, vol. 382, Feb. 1996, Item 38213.

*Primary Examiner*—Mark F. Huff
*Attorney, Agent, or Firm*—Carl O. Thomas; Andrew J. Anderson

[57] ABSTRACT

A method is disclosed of manufacturing radiation-sensitive emulsions by a pulsed flow double-jet process in which high chloride silver halide grains are grown in the presence of a thioether ripening agent in the dispersing medium in the reaction vessel the silver halide grains exhibiting an average grain roundness coefficient n in the range of from 2 to less than 15.

10 Claims, 2 Drawing Sheets

ROBUST PROCESS FOR THE PREPARATION OF HIGH CHLORIDE EMULSIONS

FIELD OF THE INVENTION

The invention is directed to a process of preparing photographic emulsions. More specifically, the invention is directed to a process of preparing high chloride cubic grain emulsions.

DEFINITION OF TERMS

The terms "high chloride" and "high bromide" refer to silver halide grains that contain greater than 50 mole percent chloride and bromide, respectively, based on silver.

In referring to silver halide grains and emulsions that contain two or more halides, the halides are named in order in ascending concentrations.

The term "regular grain" refers to a silver halide grain that is internally free ot stacking faults, which include twin planes and screw dislocations.

The term "cubic grain" refers to a regular silver halide grain including six {100} crystal planes. If a grain were a perfect cube, the six {100} crystal planes would extend over the entire exterior surface of the cubic. In practice cubic grains exhibit varying degrees of edge and corner rounding.

The term "roundness coefficient" hereinafter assigned the symbol "n" is a measure of the degree to which silver halide grain corners are rounded. n is chosen to satisfy the formula:

$$x^n+y^n=R$$

R is any vector extending from the center of a {100} crystal face of a grain to the projected peripheral edge of the grain viewed normal to the {100} crystal face;

x is an X axis coordinate of R;

v is a Y axis coordinate of R; and

Figure 2:
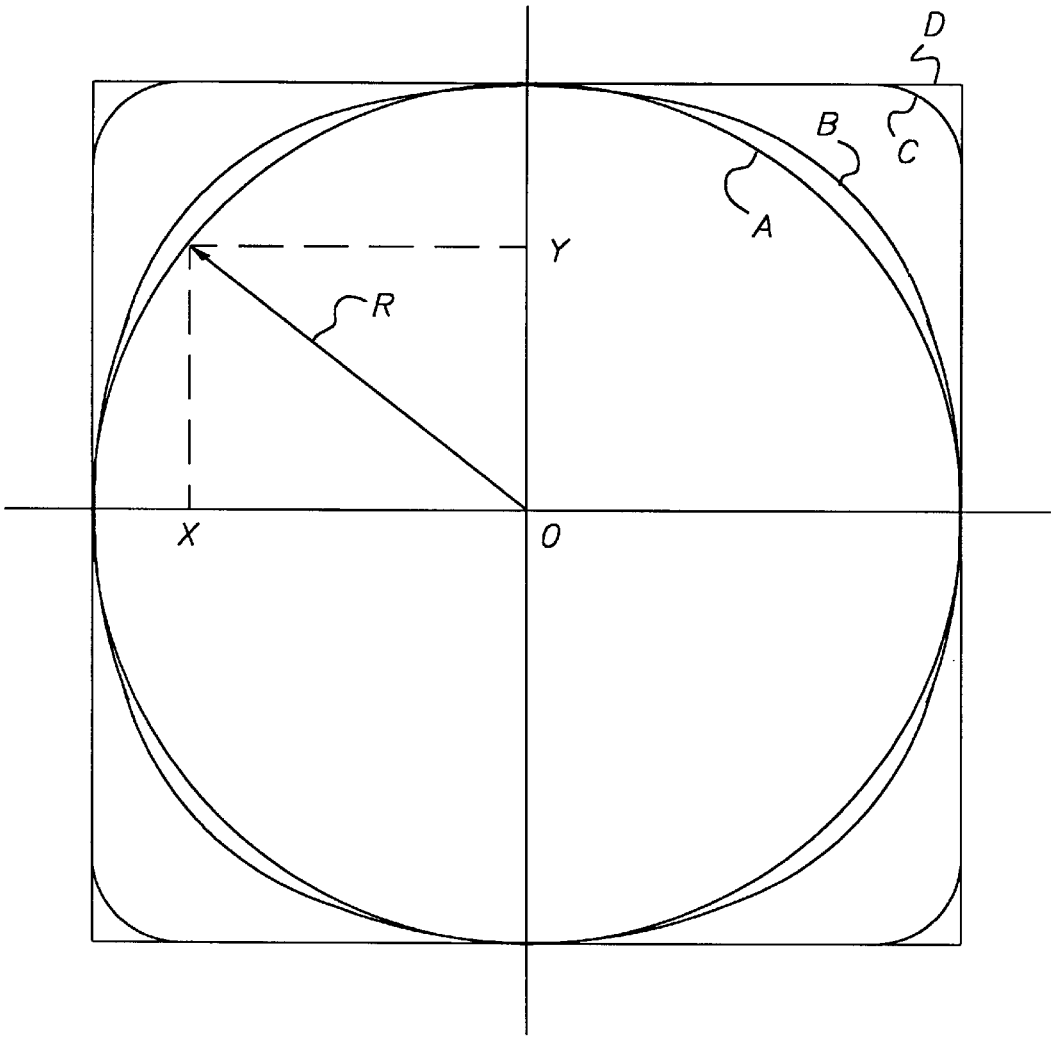
FIG. 2 is a diagram of concentric figures having varying degrees of peripheral rounding.

X and Y are mutually perpendicular axes in the plane of the {100} crystal face.

n can be better appreciated by reference to FIG. 2, wherein four peripheral boundaries A, B, C and D are shown having a common center O. Taking first the peripheral boundary A, which is a circle, it is apparent the length and orientation of R. a vector extending from the center O to any point on the peripheral boundary A of the circle can be resolved into an X axis coordinate x and a Y axis coordinate y. For the circle A (or any other circle):

$$x^2+y^2=R^2$$

Thus, for a circle, the roundness coefficient n is 2. When the roundness coefficient n is increased to 2.5, the peripheral boundary B is generated by the various combinations of x and y coordinates. When the roundness coefficient n is increased to 10, the peripheral boundary C is generated by the various combinations of x and y coordinates. When the roundness coefficient n is increased to infinity (∞), the peripheral boundary D, a square, is generated. Squares are, of course devoid of roundness. Notice that as the value n decreases from infinity to 2, the roundness of the peripheral boundary progressively increases.

Since n is infinity when the peripheral boundary defines a square and infinity not a mathematically convenient value, a common practice to is describe roundness in terms of a roundness index Q, wherein $$Q=2/n$$

The roundness index of a square is zero while the roundness index of a circle is 1. A further discussion of the mathematics of roundness is provided by Martin Gardner, "Mathematical Games", *Scientific American,* Vol. 213, (1965), p. 222 et seq.

The degree to which regular silver halide grains having {100} crystal faces exhibit corner rounding is determined by looking at the projected area of a grain in a photomicrograph viewed normal to a {100} crystal face. The value of n that most closely matches the peripheral boundary of the grain is the roundness coefficient of the grain. From measurement of a representative number ot grains, an average roundness coefficient n can be determined for an emulsion.

The term "dispersing medium" indicates the components of an emulsion other than the grains and materials adsorbed to the grain surfaces.

The term "robust" refers to the ability of an emulsion to undergo variations in its preparation with relatively small, if any, variations in grain properties.

The term "photographic processing" denotes development and any subsequent aqueous bath treatments of a silver halide photographic element performed to obtain a stable, viewable image.

*Research Disclosure,* cited below, is published by Kenneth Mason Publications, Ltd., Dudley House, 12 North St., Emsworth, Hampshire PO10 7DQ, England.

BACKGROUND OF THE INVENTION

In its most commonly practiced form silver halide photography employs a film in a camera to produce, following photographic processing, a negative image on a transparent film support. A positive image for viewing is produced by exposing a photographic print element containing one or more silver halide emulsion layers coated on a reflective white support through the negative image in the camera film, followed by photographic processing. In a relatively recent variation negative image information is retrieved by scanning and stored in digital form. The digital image information is later used to expose imagewise the emulsion layer or layers of the photographic print element.

Whereas high bromide silver halide emulsions are the overwhelming commercial choice for camera films, high chloride cubic grain emulsions are the overwhelming commercial choice for photographic print elements. The preparation of high chloride cubic grain emulsions applied to photographic print element applications are illustrated by Hasebe et al U.S. Pat. No. 4,865,962, Suzumoto et al U.S. Pat. No. 5,252,454, Oshima et al U.S. Pat. No. 5,252,456, Chen et al U.S. Pat. No. 5,736,310, Edwards et al U.S. Pat. Nos. 5,728,516 and 5,792,601, and Mydlarz et al U.S. Pat. Nos. 5,783,373 and 5,783,378.

The precipitation of silver halide emulsions in the presence of a thioether ripening agent is taught in *Research Disclosure,* Vol. 389, September 1996, Item 38957, I Emulsion grains and their preparation, E. Blends, layers and performance categories, paragraph (2).

Figure 1:
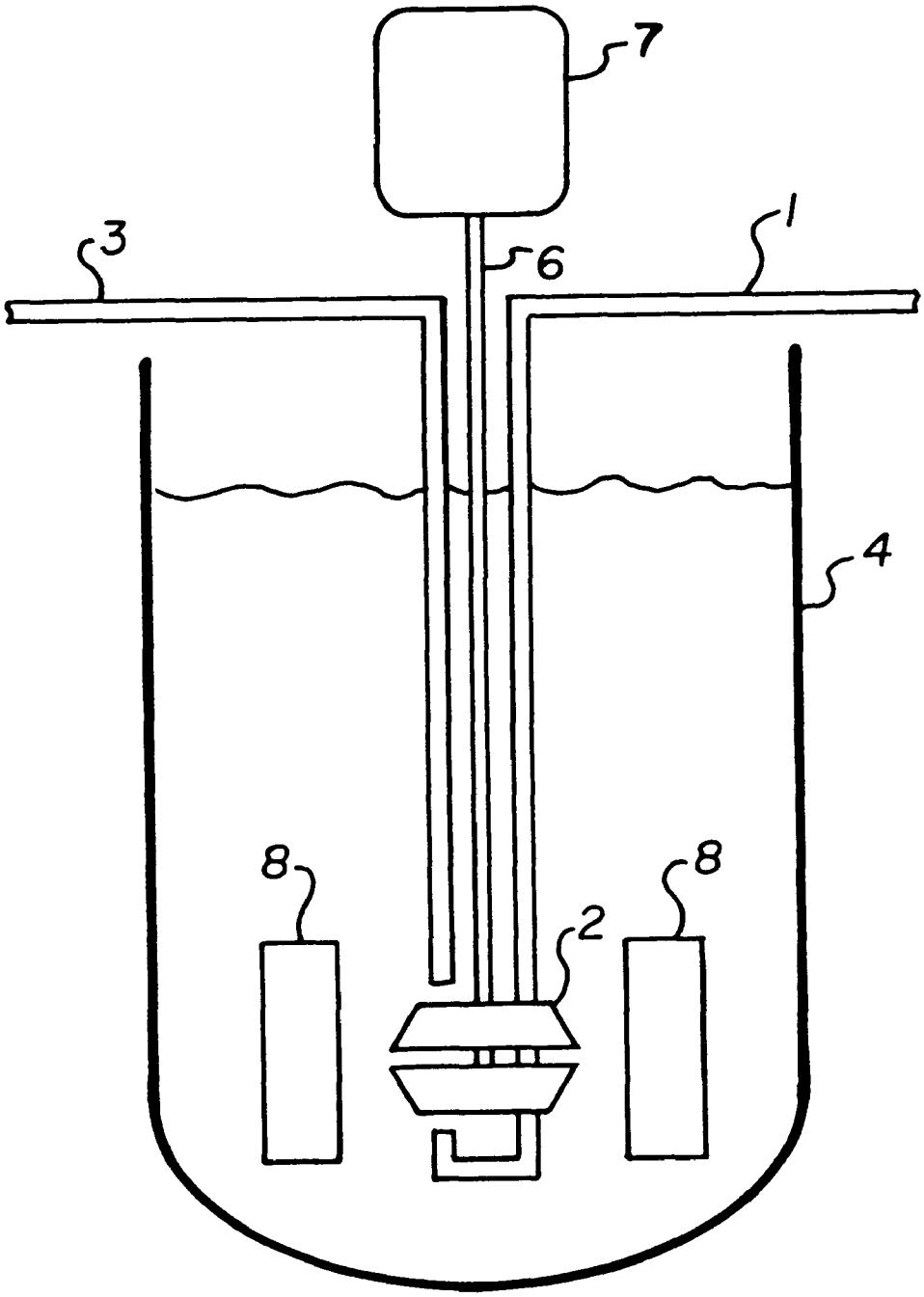
FIG. 1 is a partially schematic side elevation of a silver halide emulsion precipitation apparatus.

Chow U.S. Pat. No. 5,549,879 discloses a pulsed flow double jet technique for preparing silver halide grains. Referring to FIG. 1, Chow discloses introducing an aqueous silver nitrate solution from a remote source by a conduit 1 which terminates close to an adjacent inlet zone of a mixing device 2, which is disclosed in greater detail in *Research Disclosure,* Vol. 382, February 1996, Item 38213. Simultaneously with the introduction of the aqueous silver nitrate solution and in an opposing direction, aqueous halide solution is introduced from a remote source by conduit 3. which terminates close to an adjacent inlet zone of the mixing device 2. The mixing device is vertically disposed in vessel 4 and attached to the end of shaft 6, driven at high speed by any suitable means, such as motor 7. The lower end of the rotating mixing device is spaced up from the bottom of the vessel 4, but beneath the surface of the aqueous silver halide emulsion contained within the vessel. Baffles 8, sufficient in number of inhibit horizontal rotation of the contents of vessel 4 are located around the mixing device.

Chow teaches operating the apparatus of FIG. 1 in the following manner: (a) providing an aqueous solution containing silver halide particles having a first grain size; (b) continuously mixing the aqueous solution containing silver halide particles; (c) simultaneously introducing a soluble silver salt solution and a soluble halide salt solution into a reaction vessel of high velocity turbulent flow confined within the aqueous solution for a time t, wherein high is at least 1000 rpm; (d) simultaneously halting the introduction of the soluble silver salt solution and the soluble halide salt solution into the reaction for a time T wherein T>t, thereby allowing the silver halide particles to grow; and (e) repeating steps (c) nd (d) until the silver halide particles attain a second grain size greater than the first grain size.

Chow teaches the pulse flow technique to permit easier scalability of the precipitation method. Example 2 of Chow compares a conventional continuous double jet precipitation method with a comparable pulsed flow precipitation method. Chow reports rounded corners in the grains formed by the continuous double jet precipitation method, whereas the comparable preparation by pulsed flow produced grains with sharp edges.

The Chow method, though improving scalability, is disadvantageous in that stirring rates of at least 1000 rpm are stipulated and high chloride silver halide grains with sharp edges are produced rather than grains having more conventional degrees of corner rounding.

SUMMARY OF THE INVENTION

In one aspect, this invention is directed to a method of manufacturing radiation-sensitive emulsions containing regular grains having six {100} crystal faces comprised of (a) creating a first population of silver halide grains in a stirred aqueous dispersing medium, (b) producing a second population of silver halide grains the stirred aqueous dispersing medium by simultaneously introducing a silver salt solution and a halide salt solution into the dispersing medium (c) while continuing stirring, simultaneously halting introduction of the silver salt solution and the halide salt solution to dissolve the second grain population, and (e) repeating steps (b) and (c) until the first grain population has increased to a selected larger size, wherein (1) the halide salt solution is chosen to form silver halide grains containing greater than 50 mole percent chloride, based on silver, and (2) steps (a) through (e) are performed with a thioether ripening agent in the dispersing medium, the silver halide grains formed exhibiting an average grain roundness coefficient n in the range of from 2 to less than 15, n satisfying the formula:

$$x^n+y^n=R^n$$

in which R is any vector extending from the center of a {100} crystal face of a rain to the projected peripheral edge of the grain viewed normal to the {100} crystal face; x is an X axis coordinate of R; y is a Y axis coordinate of R; and X and Y are mutually perpendicular axes in the plane of the {100} crystal face.

It has been discovered quite unexpectedly that precipitation of high chloride silver halide emulsions by a pulsed flow double jet process in the presence of a thioether ripening agent allows robust and higher speed emulsions to be produced. The emulsions exhibit a stability of properties, particularly a desirable degree of corner rounding, that is contrary to the teachings of Chow. Grains having sharp edges, taught by Chow to be result of pulsed flow precipitation, are known to show greater batch to batch variance in properties, attributable to the greater instability of sharp edges as opposed to more customarily employed rounded corner grains.

In addition, it has been discovered that the degree of corner rounding produced by the process of the invention varies relatively little as a function of stirring rates. Thus, contrary to the teachings of Chow, there is no requirement of maintaining stirring rates greater than 1000 rpm. Thus, the method of this invention exhibits applicability to a broad range of precipitation conditions extending to precipitation conditions specifically excluded by Chow.

DETAILED DESCRIPTION OF THE INVENTION

The method of the invention pertains to the preparation of high chloride silver halide emulsions containing regular grains having six {100} crystal faces (i.e., cubic grains). In the method of the invention a conventional double jet precipitation apparatus, such as that disclosed in FIG. 1, is employed, except as noted below, as taught by Chow U.S. Pat. No. 5,549,879, described above and here incorporated by reference. A silver nitrate salt solution is introduced through conduit 3 while a halide salt solution is introduced through conduit 1. After creating a first grain population in a dispersing medium, concentrated silver and halide salt solutions are introduced simultaneously into a reactor at a relatively high flow rate for a period of time, t, sufficient to produce a new grain population. Introduction of the silver and halide salt solutions is then stopped for a period of time, T, chosen to allow the new grain population to dissolve by ripening before initiating the next introduction. These steps are then repeated until the first grain population has grown to a desired mean grain size. The quantities of silver and halide salt solutions are balanced to maintain a stoichiometric ratio of halide ion to silver ion that favors the formation of cubic grains. Silver and reference counter electrodes (not shown in FIG. 1) immersed in the dispersing medium are conventionally employed for this purpose. Since the composition of the dispersing medium remains homogeneous as a result of the introduction and mixing steps herein employed, any placement of the electrodes in the dispersing medium is feasible. The silver electrode voltage can be translated to pAg, and pAg can be converted to pCl using the equation:

$$pAg+pCl=-logKsp$$

where

Ksp is the solubility product constant of AgCl at the temperature of the dispersing medium and pAg and pCl are the negative logarithms of silver ion and chloride ion activity respectively, in the dispersing medium.

To obtain high chloride cubic grains, it is contemplated to maintain the pCl of the dispersing medium greater than 0.5, preferably greater than 1.0, and optimally greater than 1.5.

The introduction time, t, during each pulse must be of duration sufficient to allow a new grain population to be produced. Depending upon the type and scale of equipment available, the introduction time can be as low as 1 second. Contrary to the teachings of Chow, it has been observed that the pulse time t can also extend over relative long time periods. However, the pulse time t, is preferably less than 10 minutes. A convenient pulse time t is preferably in the range of from 30 seconds to 8 minutes.

The interval T following each pulse is sufficient to dissolve the new grain population from the dispersing medium by ripening. The interval T can extend over a longer time period, if desired, although this is usually avoided as unnecessarily extending the overall time of emulsion preparation. A convenient interval T is in the range of from 30 seconds to 5 minutes.

The pulse time t and interval T can conform to the teachings of Chow or differ significantly. For example, longer pulse intervals t are contemplated, and, contrary to the teachings of Chow, it is possible for the pulse time t to exceed the interval T.

The high stirring rates disclosed by Chow can also be employed, but it has been discovered that lower stirring rates are also effective. As demonstrated in the Examples below, high chloride cubic grain emulsions can be prepared with stirring rates ranging from 700 to 1750 revolutions per minute (rpm) with minimal variance in the degree of rounding of the grains.

Rounding coefficients n in the range of from 2 (preferably at least 5) to less than 15 can be realized by the presence of a thioether ripening agent in the dispersing medium within the reactor. Useful selections and concentrations of materials, including thioether ripening agents, within the reactor during precipitation are disclosed by Chen et al U.S. Pat. No. 5,736,310, Edwards et al U.S. Pat. Nos. 5,798,516 and 5,792,601, and Mydlarz et al U.S. Pat. No. 5,783,378, the disclosures of which are here incorporated by reference. Thioether ripening agents are water soluble thioethers. A thioether contains a divalent sulfur (—S—) linking two substituted or unsubstituted aliphatic hydrocarbon, typically alkyl, moieties. For example, a common preferred ripening agent is 1,8-dihydroxy-3,6-dithiaoctane. Thioether ripening agents that contain divalent oxygen linkages of hydrocarbon moieties as well as divalent sulfur linkages are specifically contemplated. Thioethers with from 2 to 30 (more typically from 4 to 24) carbon atoms are preferred. Both cyclic and acyclic thioether structures are known and useful in the practice of this invention. Further illustrations of thioether ripening agents useful in the practice of this invention are provided by McBride U.S. Pat. No. 3,271,157, Mikawa U.S. Pat. No. 4,198,240, Bryan et al U.S. Pat. Nos. 4,695,534, '535 and 4,713,322, Herz et al U.S. Pat. No. 4,782,013 and Friour et al U.S. Pat. No. 4,865,965, the disclosures of which are here incorporated by reference.

Roundness coefficients n can be obtained within the sought ranges indicated above by employing conventional concentrations of thioether ripening agents. Preferred thioether concentrations are in the range of from $1\times10^{-6}$ to $1\times10^{-1}$ mole, most preferably from $1\times10^{-4}$ to $1\times10^{-2}$ mole, per mole of final silver. In other words, the silver basis is the total silver introduced into the reaction vessel during precipitation.

In addition to controlling the average roundness coefficient n of the grains, the thioether ripening agents contribute other desirable characteristics to the emulsions prepared. They normally shorten the precipitation time required to reach a selected mean grain size. In addition, they can enhance the sensitivity of the grains, modify grain size-frequency distributions, and reduce storage periods required to arrive at stable levels of sensitivity.

In preparing high chloride cubic grain emulsions, it is common practice to deposit epitaxially onto the grains silver bromide during the course of chemical sensitization. The rounded portions of the high chloride cubic grains preferentially accept silver bromide epitaxy. In addition, many spectral sensitizing dyes that are adsorbed to grain surfaces show definite crystal plane preferences. Thus, by reducing the grain to grain and batch to batch variance of the roundness coefficient, more uniform and more repeatable sensitizations of the emulsions can be realized.

The high chloride grains present in the dispersing medium at the conclusion of the precipitation process of this invention contain greater than 50 mole percent chloride, based on silver. Preferably the chloride concentration is at least 70 mole percent chloride, based on silver, and optimally at least 90 mole percent chloride, based on silver. The grains can consist essentially of silver chloride as the sole silver halide, if desired. Typically the balance of the halide not accounted for by chloride is bromide. Commonly high chloride grains intended for color print applications are essentially free of iodide, where "essentially free" is in most patents defined as less than 1 or 2 mole percent, based on silver. The established practice of the art has been to avoid the intentional incorporation of iodide during the precipitation of high chloride cubic grain precipitations where print element applications are contemplated for the emulsions. Contrary to the established art practice of eliminating or minimizing the incorporation of iodide in high chloride grains intended for use in print element applications, Chen et al U.S. Pat. No. 5,736,310 and Edwards et al U.S. Pat. Nos. 5,728,516 and 5,792,601, cited and incorporated by reference above, disclose advantageous increases in imaging speed to be realized by incorporating from 0.05 to 3.0 mole percent iodide, based on silver, in the high chloride grains.

The proportion of the total aqueous dispersing medium present in the reactor prior to silver halide precipitation amounts to at least 10 percent, by weight, of the total weight of the dispersing medium at the conclusion of precipitation. By conducting ultrafiltration during precipitation, as taught by Mignot U.S. Pat. No. 4,334,012, it is possible to maintain a constant volume of reactants in the reactor throughout the precipitation. Most precipitations are conducted with from 20 to 80 percent of the total aqueous dispersing medium in the reactor prior to silver halide precipitation.

During precipitation any convenient grain peptizer can be present. As taught by Mignot U.S. Pat. No. 4,334,012, no peptizer is required during grain nucleation and initial growth. However, typically at least 10 percent and preferably at least 20 percent of the total peptizer present in the emulsion at the conclusion of precipitation is present in the dispersing medium prior to initiating silver halide precipitation. It is contemplated that the emulsions at the conclusion of precipitation will contain from 5 to 50 (preferably 10 to 30) grams of peptizer, per mole of silver halide.

Conventional choices of peptizers are summarized in *Research Disclosure,* Item 38957, II. Vehicles, vehicle extenders, vehicle-like addenda and vehicle related addenda, A. Gelatin and hydrophilic colloid peptizers. Gelatin and gelatin derivatives, such as phthalated or acetylated, constitute preferred peptizers.

The preparation of high chloride cubic grain emulsions for photographic use following precipitation can take any convenient conventional form. A general summary of conventional emulsion features, exposure and photographic processing following precipitation are provided in *Research Disclosure,* Item 38957, Sections II through XX.

EXAMPLES

The invention can be better appreciated by reference to the following specific embodiments.

Example 1 comparison

To a reactor of the type disclosed in FIG. 1 incorporating a stirring device as disclosed in *Research Disclosure,* Item 38213, and containing 8.764 Kg of distilled water and 251 g of bone gelatin, were added 291 g of 3.8 M sodium chloride salt solution such that the mixture was maintained at a pCl of about 1.05 at approximately 68° C. To this were added 1.9 g of 1,8-dihydroxy-3,6-dithiaoctane approximately 30 seconds before commencing introduction of silver and chloride salt solutions. Aqueous solutions of about 3.7 M silver nitrate and about 3.8 M sodium chloride were then added by conventional controlled double-jet addition at a constant silver nitrate flow rate of about 74 mL/min for about 41 minutes while maintaining pCl constant at about 1.05. Both the silver and sodium salt solution pumps were then turned off and about 0.4 M potassium iodide solution was added to the stirred reaction mixture about 3 minutes at a constant flow rate of about 21 mL/min. The resultant iodochloride emulsion was then grown further by conventional controlled double-jet addition for about 4.5 minutes by resumed addition of silver and sodium salt solutions at about 74 mL/min at a pCl of about 1.05. The stirring speed of stirring device was maintained at 1500 revolutions per minute during the entire precipitation process.

A silver iodochloride cubic grain emulsion was prepared having the characteristics summarized below in Table I.

Example 2 comparison

Example 1 was repeated, except that the rotation of the stirring device was maintained at 2250 rpm. A silver iodochloride cubic grain emulsion was prepared having the characteristics summarized below in Table I.

Example 3 comparison

Example 1 was repeated, except that the rotation of the stirring device was maintained at 3000 rpm. A silver iodochloride cubic grain emulsion was prepared having the characteristics summarized below in Table I.

Example 4 invention

To a reactor of the type disclosed in FIG. 1 incorporating a stirring device as disclosed in *Research Disclosure,* Item 38213, and containing 8.764 Kg of distilled water and 251 g of bone gelatin, were added 291 g of 3.8 M sodium chloride salt solution such that the mixture was maintained at a pCl of about 1.05 at approximately 68° C. To this were added 1.9 g of 1,8-dihydroxy-3,6-dithiaoctane approximately 30 seconds before commencing introduction of silver and chloride salt solutions. Aqueous solutions of about 3.7 M silver nitrate and about 3.8 M sodium chloride were then added by conventional controlled double-jet addition at a constant silver nitrate flow rate of about 82 mL/min for about 1.75 minutes while maintaining pCl constant at about 1.05.

Then the silver nitrate and sodium chloride salt solution were introduced into the reactor simultaneously in sixteen discrete pulses. Each pulse consisted of a constant silver nitrate flow rate of 350 mL/min and a balancing flow rate of sodium chloride solution such that pCl is maintained at approximately 1.05. The following sequence of pulses and intervals were employed:

| event | minutes |
|---|---|
| pulse 1 | 0.5 |
| interval | 10 |
| pulse 2 | 0.5 |
| interval | 5 |
| pulse 3 | 0.5 |
| interval | 5 |
| pulse 4 | 0.33 |
| interval | 2 |
| pulse 5 | 0.33 |
| interval | 2 |
| pulse 6 | 0.33 |
| interval | 2 |
| pulse 7 | 0.33 |
| interval | 2 |
| pulse 8 | 0.33 |
| interval | 2 |
| pulse 9 | 0.33 |
| interval | 2 |
| pulse 10 | 0.7 |
| interval | 2 |
| pulse 11 | 0.8 |
| interval | 2 |
| pulse 12 | 0.8 |
| interval | 2 |
| pulse 13 | 0.51 |
| interval | 2 |
| pulse 14 | 0.48 |
| interval | 2 |
| pulse 15 | 0.48 |
| interval | 2 |
| pulse 16 | 0.95 |
| interval | 4 |

Both the silver and sodium salt solution pumps were then turned off and about 0.4 M potassium iodide solution was added to the stirred reaction mixture about 3 minutes at a constant flow rate of about 21 mL/min. The resultant iodochloride emulsion was then grown further by the pulse process by way of two additional pulses similar to those described above. The duration of the pulses were 0.5 and 0.48 minute, respectively, and the duration of the interval following the pulse was 2 and 3 minutes, respectively. The stirring speed of the mixing device was maintained at 1750 rpm during the entire precipitation process.

A silver iodochloride cubic grain emulsion was prepared having the characteristics summarized below in Table I.

Example 5 invention

Example 1 was repeated, except that the rotation of the stirring device was maintained at 2250 rpm. A silver iodochloride cubic grain emulsion was prepared having the characteristics summarized below in Table I.

Example 6 invention

Example 1 was repeated, except that the rotation of the stirring device was maintained at 2750 rpm. A silver iodochloride cubic grain emulsion was prepared having the characteristics summarized below in Table I.

TABLE I

| Example | Edge Length (μm) | Roundness Coefficient | Stirring (rpm) | Pulsed Flow |
|---|---|---|---|---|
| 1 (comp.) | 0.64 | 16.7 | 1500 | no |
| 2 (comp.) | 0.65 | 10.5 | 2250 | no |
| 3 (comp.) | 0.65 | 8.7 | 3000 | no |
| 4 (inv.) | 0.66 | 10 | 1750 | yes |
| 5 (inv.) | 0.67 | 10 | 2250 | yes |
| 6 (inv.) | 0.67 | 10 | 2750 | yes |

From Table I it is apparent that, when a conventional double jet precipitation was undertaken without pulsed addition of reactants, the roundness coefficient of the cubic grains varied as a function of the stirring rate. On the other hand, with pulsed flow additions, the roundness index remained constant, independent of the stirring rate selected.

Examples 7 and 8

Whereas Chow teaches that a stirring rate of at least 1000 rpm is required for pulsed flow double jet precipitations, the following examples demonstrate that stirring rates can be varied widely when pulsed flow additions with minimal impact on roundness coefficients.

Example 7 invention

To a reactor of the type disclosed in FIG. 1 incorporating a stirring device as disclosed in *Research Disclosure,* Item 38213, and containing 407 g of distilled water and11.8 g of bone gelatin, were added 13.5 g of 3.8 M sodium chloride salt solution such that the mixture was maintained at a pCl of about 1.05 at approximately 68° C. To this were added 0.09 g of 1,8-dihydroxy-3,6-dithiaoctane approximately 30 seconds before commencing introduction of silver and chloride salt solutions. Aqueous solutions of about 3.7 M silver nitrate and about 3.8 M sodium chloride were then added by conventional controlled double-jet addition at a constant silver nitrate flow rate of about 3.8 mL/min for about 1.75 minutes while maintaining pCl constant at about 1.05.

Then the silver nitrate and sodium chloride salt solution were introduced into the reactor simultaneously in eighteen discrete pulses. Each pulse consisted of a constant silver nitrate flow rate of 16.3 mL/min and a balancing flow rate of sodium chloride solution such that pCl is maintained at approximately 1.05. The following sequence of pulses and intervals were employed:

| event | minutes |
|---|---|
| pulse 1 | 0.5 |
| interval | 10 |
| pulse 2 | 0.5 |
| interval | 5 |
| pulse 3 | 0.5 |
| interval | 5 |
| pulse 4 | 0.33 |
| interval | 2 |
| pulse 5 | 0.33 |
| interval | 2 |
| pulse 6 | 0.33 |
| interval | 2 |

-continued

| event | minutes |
|---|---|
| pulse 7 | 0.33 |
| interval | 2 |
| pulse 8 | 0.33 |
| interval | 2 |
| pulse 9 | 0.33 |
| interval | 2 |
| pulse 10 | 0.7 |
| interval | 2 |
| pulse 11 | 0.8 |
| interval | 2 |
| pulse 12 | 0.8 |
| interval | 2 |
| pulse 13 | 0.51 |
| interval | 2 |
| pulse 14 | 0.48 |
| interval | 2 |
| pulse 15 | 0.48 |
| interval | 2 |
| pulse 16 | 0.95 |
| interval | 4 |
| pulse 17 | 0.5 |
| interval | 2 |
| pulse 18 | 0.48 |
| interval | 3 |

The stirring speed ot the stirring device was maintained at 700 rpm during the entire precipitation process.

A silver chloride cubic grain emulsion was prepared having the characteristics summarized below in Table II.

Example 8 invention

Example 7 was repeated, except that the rotation of the stirring device was maintained at 1750 rpm. A silver chloride cubic grain emulsion was prepared having the characteristics summarized below in Table II.

TABLE II

| Example | Edge Length (μm) | Roundness Coefficient | Stirring (rpm) | Pulsed Flow |
|---|---|---|---|---|
| 7 | 0.67 | 6.9 | 700 | yes |
| 8 | 0.69 | 6.5 | 1750 | yes |

From Table II it is apparent that the roundness coefficient varied less than 10 percent with a stirring speed acceleration of 150 percent. From this it was concluded that pulsed flow emulsions of similar grain characteristics could be produced using reactors differing widely in their stirring capabilities. Hence, the process of the invention represents a highly robust process for the preparation of high chloride cubic grain emulsions.

The invention has been described in detail with particular reference to certain preferred embodiments thereof, but it will be understood that variations and modifications can be effected within the spirit and scope of the invention.

| PARTS LIST | |
|---|---|
| 1 | conduit |
| 2 | mixing device |
| 3 | conduit |
| 4 | vessel |
| 6 | shaft |

-continued

| PARTS LIST | |
|---|---|
| 7 | motor |
| 8 | baffles |
| O | center |
| A | circle |
| B | grain boundary |
| C | grain boundary |
| D | square |
| R | vector |
| x | X axis coordinate |
| y | Y axis coordinate |

What is claimed is:

1. A method of manufacturing radiation-sensitive emulsions containing regular grains having six {100} crystal faces which extend to projected peripheral edges of the grain viewed normal to the {100} crystal faces, comprised of (a) creating a first population of silver halide grains in a stirred aqueous dispersing medium, (b) producing a second population of silver halide grains in the stirred aqueous dispersing medium by simultaneously introducing a silver salt solution and a halide salt solution into the dispersing medium, (c) while continuing stirring, simultaneously halting introduction of the silver salt solution and the halide salt solution to dissolve the second grain population, and (d) repeating steps (b) and (c) until the first grain population has increased to a selected larger size,

WHEREIN (1) the halide salt solution is chosen to form silver halide grains containing greater than 50 mole percent chloride, based on silver, and (2) steps (a) through (d) are performed with a thioether ripening agent in the dispersing medium, the silver halide grains formed exhibit an average grain roundness coefficient n in the range of from 2 to less than 15, n satisfying the formula:

$$x^n+y^n=R^n$$

in which

R is any vector extending from the center of a {100} crystal face of a grain to the projected peripheral edge of the grain viewed normal to the {100} crystal face;

x is an X axis coordinate of R;

y is a Y axis coordinate of R; and

X and Y are mutually perpendicular axes in the plane of the {100} crystal face.

2. A method of manufacturing radiation-sensitive emulsions according to claim 1 wherein the grains formed contain greater than 70 mole percent chloride, based on silver.

3. A method of manufacturing radiation-sensitive emulsions according to claim 2 wherein the grains formed greater than 90 mole percent chloride, based on silver.

4. A method of manufacturing radiation-sensitive emulsions according to claim 1 wherein the grains are silver iodochloride grains containing from 0.05 to 3 mole percent iodide, based on silver.

5. A method of manufacturing radiation-sensitive emulsions according to claim 1 wherein the roundness coefficient n is in the range of from 4 to 15.

6. A method of manufacturing radiation-sensitive emulsions according to claim 1 wherein a rotatable stirring head is employed that is rotated at less than 1000 revolutions per minute.

7. A method of manufacturing radiation-sensitive emulsions according to claim 1 wherein successive emulsion preparations are conducted using a rotatable stirring head rotated in the range of from 700 to 1750 revolutions per minute, the revolutions per minute being changed by greater than 200 revolutions per minute from one emulsion preparation to the next while changing the roundness index n of the emulsions prepared by less than 10 percent.

8. A method of manufacturing radiation-sensitive emulsions according to claim 1 wherein the time t elapsed in step (a) exceeds the time T elapsed in step (b).

9. A method of manufacturing radiation-sensitive emulsion according to claim 1 wherein the time t elapsed in step (a) is less than 10 minutes and the time T elapsed in step (b) ranges from 30 seconds to 5 minutes.

10. A method of manufacturing radiation-sensitive emulsions according to claim 9 wherein time t is in the range of from 30 seconds to 8 minutes.

* * * * *